US008827747B2

(12) United States Patent
Tanaka et al.

(10) Patent No.: US 8,827,747 B2
(45) Date of Patent: Sep. 9, 2014

(54) ELECTRIC CABLE WITH SHIELDED CONNECTOR

(71) Applicant: Yazaki Corporation, Tokyo (JP)

(72) Inventors: Masahiro Tanaka, Kakegawa (JP); Hajime Kato, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/062,256

(22) Filed: Oct. 24, 2013

(65) Prior Publication Data

US 2014/0051282 A1 Feb. 20, 2014

Related U.S. Application Data

(63) Continuation of application No. PCT/JP2012/064328, filed on Jun. 1, 2012.

(30) Foreign Application Priority Data

Jun. 2, 2011 (JP) ..... 2011-124437
Nov. 25, 2011 (JP) ..... 2011-258038

(51) Int. Cl.
*H01R 13/658* (2011.01)
*H01R 13/6581* (2011.01)
*H01R 13/6593* (2011.01)

(52) U.S. Cl.
CPC ..... *H01R 13/6581* (2013.01); *H01R 13/6593* (2013.01); *Y10S 439/904* (2013.01)
USPC ..... 439/607.27; 439/607.41; 439/607.55; 439/904

(58) Field of Classification Search
CPC ..... H01R 13/6581; H01R 13/6591; H01R 13/6593
USPC ..... 439/607.27, 607.45, 607.47, 607.55, 439/607.56, 901, 904, 905, 906
See application file for complete search history.

(56) References Cited

U.S. PATENT DOCUMENTS 4,508,414 A * 4/1985 Kusui et al. ..... 439/607.47
5,308,264 A * 5/1994 Perretta et al. ..... 439/607.46

(Continued)

FOREIGN PATENT DOCUMENTS

JP 2003197037 A 7/2003
JP 2004171952 A 6/2004

(Continued)

OTHER PUBLICATIONS

English Translation of Written Opinion, dated Jul. 24, 2012, issued by the International Searching Authority in counterpart International Application No. PCT/JP2012/064328.

(Continued)

*Primary Examiner* — James Harvey
(74) *Attorney, Agent, or Firm* — Sughrue Mion, PLLC

(57) ABSTRACT

An electric cable with shielded connector includes a flexible electric wire, shielded connectors that are respectively attached on the flexible electric wire, and a shield cover that is provided to cover an outer side of the electric wire. The shield cover is constituted of two cylindrical shield covers made of a conductive metal plate. One end of each of the two cylindrical shield covers is respectively fixed on shield shells of the shield connectors on both ends of the electric wire. The other end of each of the two cylindrical shield covers is formed as a free end, and the free ends of the two cylindrical shield covers are abutted to each other or are lapped on each other.

5 Claims, 12 Drawing Sheets

(56) References Cited

U.S. PATENT DOCUMENTS

| | | | | |
|---|---|---|---|---|
| 5,727,971 | A * | 3/1998 | Junkins et al. | 439/607.49 |
| 7,074,057 | B2 * | 7/2006 | Chiran et al. | 439/92 |
| 7,128,614 | B1 * | 10/2006 | Wu | 439/638 |
| 7,229,316 | B2 * | 6/2007 | Takaku et al. | 439/607.56 |
| 7,465,196 | B2 * | 12/2008 | Duarte et al. | 439/607.41 |
| 7,544,068 | B2 * | 6/2009 | Glaab et al. | 439/97 |
| 7,695,320 | B2 * | 4/2010 | Tsukashima et al. | 439/607.44 |
| 2003/0119351 | A1 | 6/2003 | Miyazaki et al. | |
| 2004/0065472 | A1 * | 4/2004 | Sekijima et al. | 174/250 |
| 2004/0099427 | A1 | 5/2004 | Kihira | |
| 2007/0207652 | A1 * | 9/2007 | Tsuruta | 439/166 |
| 2013/0065405 | A1 * | 3/2013 | Tsuchiya et al. | 439/34 |
| 2014/0051282 | A1 * | 2/2014 | Tanaka et al. | 439/502 |

FOREIGN PATENT DOCUMENTS

| | | | |
|---|---|---|---|
| JP | 2005317257 | A | 11/2005 |
| JP | 2007234422 | A | 9/2007 |
| JP | 2010282924 | A | 12/2010 |

OTHER PUBLICATIONS

International Search Report, dated Jul. 24, 2012, issued by the International Searching Authority in counterpart International Application No. PCT/JP2012/064328.

Written Opinion, dated Jul. 24, 2012, issued by the International Searching Authority in counterpart International Application No. PCT/JP2012/064328.

* cited by examiner

FIG. 3A
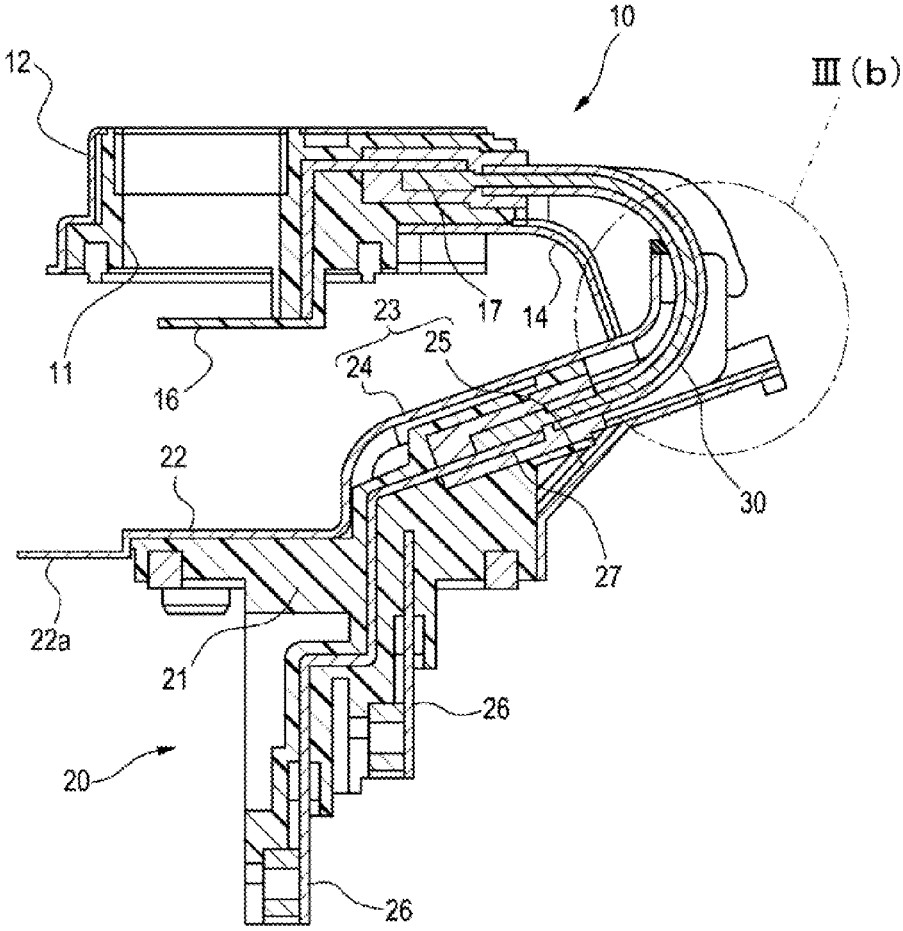
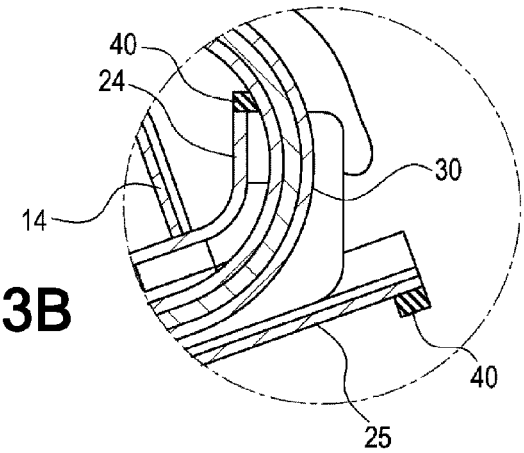
FIG. 3B

--Related Art--

--Related Art--

ELECTRIC CABLE WITH SHIELDED CONNECTOR

CROSS REFERENCE TO RELATED APPLICATION

This application is a continuation of PCT application No. PCT/JP2012/064328 which was filed on Jun. 1, 2012, based on based on Japanese Patent Application No. 2011-124437 filed on Jun. 2, 2011 and Japanese Patent Application No. 2011-258038 filed on Nov. 25, 2011, the entire contents of which are incorporated herein by reference.

BACKGROUND OF THE INVENTION

1. Technical Field

The present invention relates to an electric cable with shield connector having shield connectors attached on both ends to connect, for example, between two instruments.

2. Background Art

In a conventional electric cable with shield connector 101 shown in FIGS. 11 and 12, shielded connectors 110 and 120 are respectively attached on both ends of a flexible electric wire 130, and the shielded connectors 110 and 120, respectively, include terminals 116 and 126 connected to a conductor of the electric wire 130, insulation material housings 111 and 121 for holding the terminals 116 and 126, and shield shells 112 and 122 for covering an outer side of the housings 111 and 121. In addition, a braid 140 as a shield cover is provided to cover an outer side of the electric wire 130 exposed between the shielded connectors 110 and 120 on both ends thereof, and both ends of the braid 140 are respectively fixed on cylindrical portions of the shield shells 112 and 122 of the shield connectors 110 and 120 by caulking shield rings 150. The braid 140 is used to ensure some movability between the shield connectors 110 and 120 on both ends.

Examples of the electric cable with shielded connector of such a type are disclosed in PTL1 and PTL2.

Also, instead of covering the electric wire between two shield connectors with the braid, a configuration of covering the electric wire with a shield pipe is disclosed in PTL3.

CITATION LIST

PTL1: JP 2010-282924 A
PTL2: JP 2003-197037 A
PTL3: JP 2004-171952 A

SUMMARY

According to the conventional electric cable with shield connector 101 as described above, the braid 140 is used as the shield cover for shielding the outer side of the electric wire 130, and also the shield rings 150 is caulked to fix both ends of the braid 140 to the shield shells 112 and 122. Accordingly, there was a problem in that the number of components is increased by an amount required for the shield rings 150 and correspondingly, assembling man-hours are also increased. In addition, there is a risk that, if the braid 140 collides with other components due to vibrations of instruments or a vehicle, or the like, the braid 140 weaker in strength than the shield shells 112 and 122 made of a metal plate or the like is damaged.

Further, in the configuration of covering the electric wire with the shield pipe, although a protector for protecting the electric wire is not required, components, such as the shield pipe, to be separately manufactured are newly required.

The present invention has been made keeping in mind the above problems, and an object thereof is to provide an electric cable with shielded connector, which can ensure shielding ability and movability between shielded connectors on both ends, achieve reduction of the number of components and reduction of assembling man-hours, is not damaged even if colliding with other components due to vibrations or the like, and also does not need separate components newly manufactured.

The above object of the present invention is achieved by the following configurations.

(1) An electric cable with shielded connector, including shielded connectors respectively attached on both ends of a flexible electric wire, and a shield cover provided to cover an outer side of the electric wire between the shielded connectors on both ends thereof, the shielded connectors each including a terminal electrically connected to a conductor of the electric wire, an insulation material housing for holding the terminal, and a shield shell for covering an outer side of the housing;

wherein the shield cover is constituted of two cylindrical shield covers made of a conductive metal plate, one end of each of the two cylindrical shield covers is respectively fixed on the shield shells of the shield connectors on both ends of the electric wire, the other end of each of the two cylindrical shield covers is formed as a free end, and the free ends of the two cylindrical shield covers are abutted to each other or are lapped on each other, thereby ensuring shielding ability between the free ends of the two cylindrical shield covers.

(2) The electric cable with shielded connector according to the above (1), wherein the two cylindrical shield covers are respectively constituted of a combination of a pair of semi-cylindrical bodies, whose side edges are lapped on each other, and wherein one semi-cylindrical body of the pair of semi-cylindrical bodies is fixed on the shield shell and the other semi-cylindrical body is detachably fixed on the shield shell or the one semi-cylindrical body.

(3) The electric cable with shielded connector according to the above (1) or (2), wherein a conductive elastic member is interposed between the free ends of the two cylindrical shield covers to shield a gap between the free ends and also to prevent a direct contact between the free ends.

(4) The electric cable with shielded connector according to the above (2), wherein the free ends of the two cylindrical shield covers are lapped on each other, and wherein the semi-cylindrical body, which becomes an inner side in lapped portions between side edges, of a pair of semi-cylindrical bodies of one cylindrical shield cover, which is lapped on an outer side of the other cylindrical shield cover, which becomes an inner side in lapped portions of the free ends of the two cylindrical shield covers, is formed to have a dimension which can ensure a gap between the semi-cylindrical body and the other cylindrical shield cover in a free state, and also the semi-cylindrical body, which becomes an outer side in the lapped portions between side edges, of the pair of semi-cylindrical bodies of the one cylindrical shield cover, is formed to have a dimension which can cause the inner side semi-cylindrical body to be pressed and deformed inward, as the semi-cylindrical body is fitted on the inner side semi-cylindrical body in the free state from the rear side to allow the side edges to be lapped on each other, so that the gap is eliminated and thus the inner side semi-cylindrical body are pressed against and closely contacted to the other cylindrical shield cover.

According to the electric cable with shielded connector of the above configuration (1), because the outer side of the electric wire between the shielded connectors on both ends thereof is covered with two cylindrical shield covers made of a conductive metal plate, shielding ability of the electric wire exposed between the shielded connectors can be ensured.

Also, the other end of each of two cylindrical shield covers is separated from each other and is formed as the free ends, but the free ends are abutted to each other or are lapped on each other, and as a result, shielding ability of the gap between the free ends can be ensured, thereby eliminating a shield omission portion (i.e., a portion having an insufficient shielding ability against electromagnetic waves).

Further, two cylindrical shield covers are constituted of a conductive metal plate, and the one end of each thereof is respectively fixed to the shield shells of the shielded connectors, and as a result, cumbersome works, such as caulking and fixing a flexible braid to a shield shell by a shield ring as in a conventional case, are not required, thereby achieving reduction of the number of components and reduction of operation man-hours.

Further, because two cylindrical shield covers are not coupled and fixed to each other, but each can relatively freely move to some extent, movability between the shielded connectors on both ends can ensured to a required extent, thereby preventing disturbing some movement required upon connection of the shielded connectors.

Also, two cylindrical shield covers are made of the metal plate serving as a protection portion having impact resistance, and as a result, are not damaged even if colliding with other components due to vibrations of instruments or a vehicle, or the like.

Further, because the electric cable with shielded connector can be manufactured only by modifying the shield shells, it is not necessary to newly provide molds to manufacture separate components.

According to the electric cable with shielded connector of the above configuration (2), because two cylindrical shield covers are respectively constituted of a combination of a pair of semi-cylindrical bodies, whose side edges are lapped on each other, the cylindrical shield covers can be assembled on the outer side of the electric wire after each of pairs of semi-cylindrical bodies is opened and then the shielded connectors are attached on both ends of the electric wire. Therefore, a degree of freedom in an assembly operation can be ensured.

According to the electric cable with shielded connector of the above configuration (3), because the conductive elastic member is disposed between the free ends of two cylindrical shield covers, the conductive elastic member can fill up a gap between the free ends of two cylindrical shield covers, thereby surely eliminating shield omission.

Also, two cylindrical shield covers are electrically connected to each other through the conductive elastic member, and therefore, by only earthing the shield shell or the shield cover of one shield connector, shielding ability of the shield shell or the shield cover of the other shield connector can be ensured.

In addition, because a direct contact between the cylindrical shield covers made of a conductive metal plate can be avoided due to the conductive elastic member, a damage or noise caused by contact between hard metal plates due to vibrations of instruments can be prevented.

According to the electric cable with shielded connector of the above configuration (4), the semi-cylindrical body, which becomes the inner side in the lapped portions between side edges, of the pair of semi-cylindrical bodies of one cylindrical shield cover, which becomes the outer side in the lapped portions between the free ends of two cylindrical shield covers, is formed to have a dimension which can ensure a gap between the semi-cylindrical body and the other cylindrical shield cover in a free state. Accordingly, in a state before the outermost semi-cylindrical body is assembled, the gap exists, and therefore, rubbing (sliding) between the inner side semi-cylindrical body and the other cylindrical shield cover can be prevented. As a result, the lapped portions between the free ends of two cylindrical shield covers can be smoothly moved.

In addition, in a state where the outermost semi-cylindrical body has been assembled, the inner side semi-cylindrical body can be pressed and deformed inward to be pressed against and closely contacted to the other cylindrical shield cover and thereby to eliminate the gap, and therefore, two cylindrical shield covers can be surely maintained in an electrically interconnected state and a high shielding performance can be exhibited.

BRIEF DESCRIPTION OF DRAWINGS

FIG. 3A is a sectional view showing a state where the electric cable with shielded connector is being assembled, and FIG. 3B is an enlarged view showing a main part III(b) in FIG. 3A.

FIGS. 9A and 9B are perspective views showing the electric cable with shielded connector, in which FIG. 9A shows a state before an outermost semi-cylindrical body thereof is assembled, and FIG. 9B shows a completed state after the outermost semi-cylindrical body has been assembled.

DESCRIPTION OF EMBODIMENTS

Figure 1:
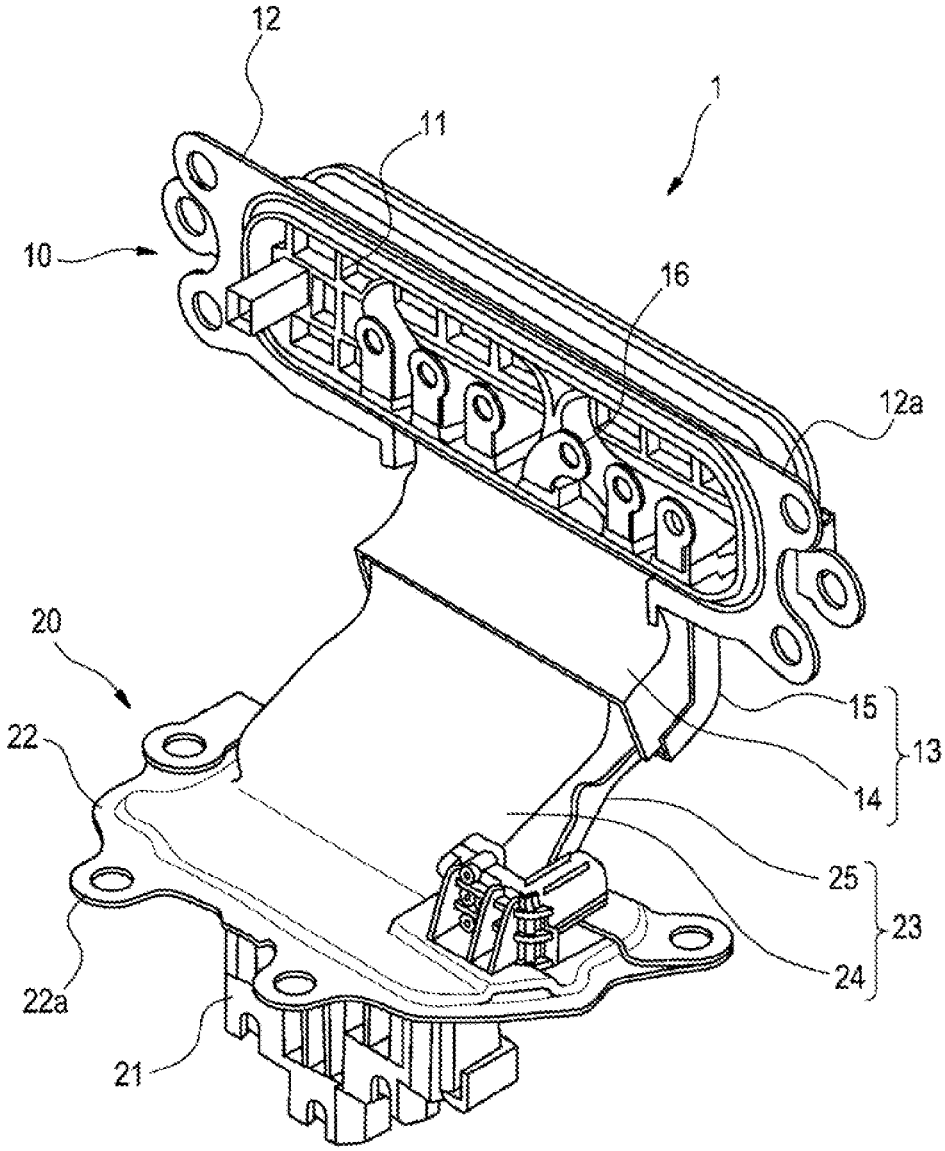
FIG. 1 is a perspective view showing the exterior of an electric cable with shielded connector according to a first embodiment of the present invention.

Embodiments of the present invention will be now described with reference to the accompanying drawings.

As shown in FIGS. 1 to 3B, an electric cable with shielded connector 1 with according to a first embodiment of the present invention is an electric cable, in which shielded connectors 10 and 20 are respectively attached on both ends of a flexible electric wire 30, the shielded connectors 10 and 20, respectively, include terminals 16 and 26 electrically connected to a conductor of the electric wire 30, insulation material housings 11 and 21 for holding the terminals 16 and 26, and shield shells 12 and 22 for covering an outer side of the housings 11 and 21, and two cylindrical shield covers 13 and 23 made of a conductive metal plate are provided to cover an outer side of the electric wire 30 exposed between the shielded connectors 10 and 20 on both ends.

Figure 2A:
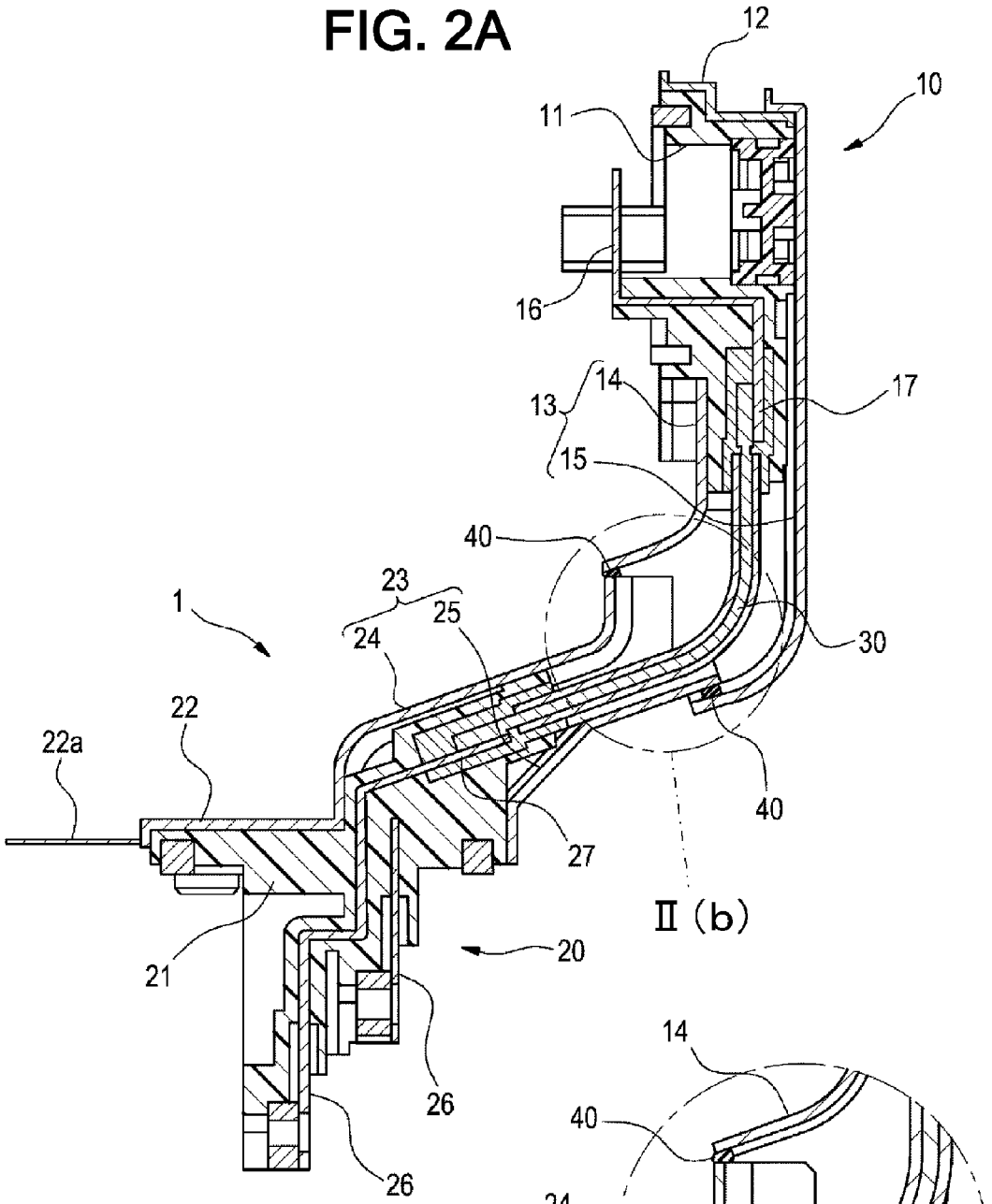
FIG. 2A is a sectional view showing the electric cable with shielded connector.
Figure 2B:
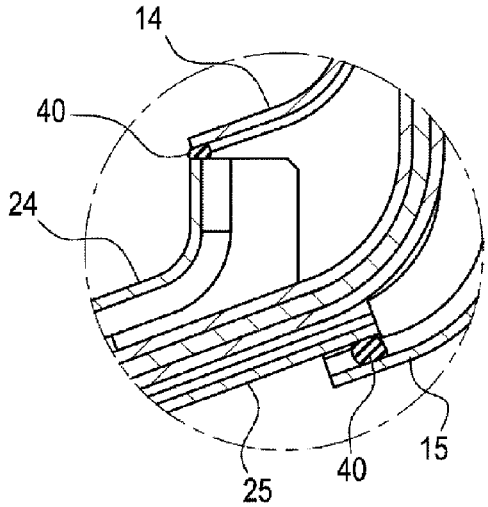
FIG. 2B is an enlarged view showing a main part II(b) in FIG. 2A.
Figure 4:
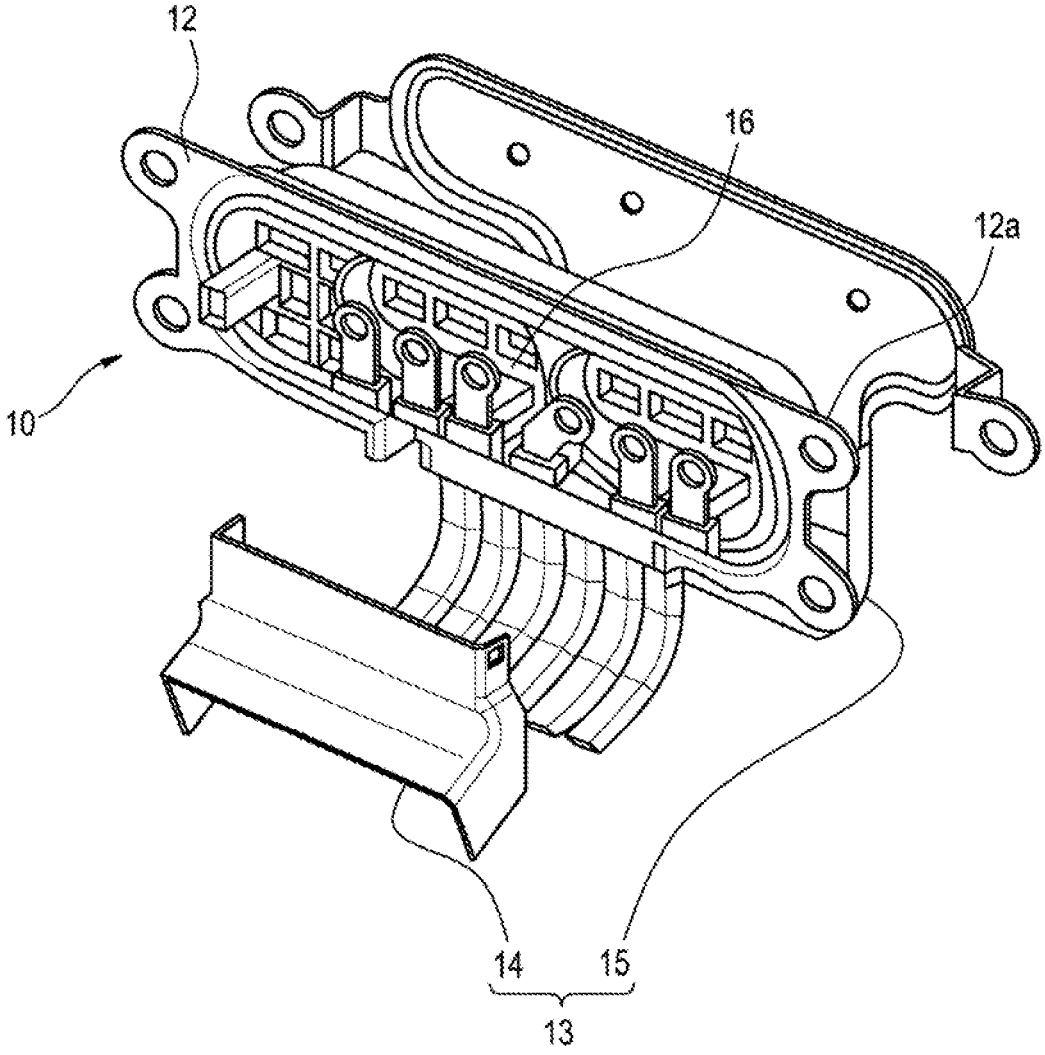
FIG. 4 is an exploded perspective view showing an upper shielded connector of an electric cable with shielded connector according to a second embodiment of the present invention.
Figure 5:
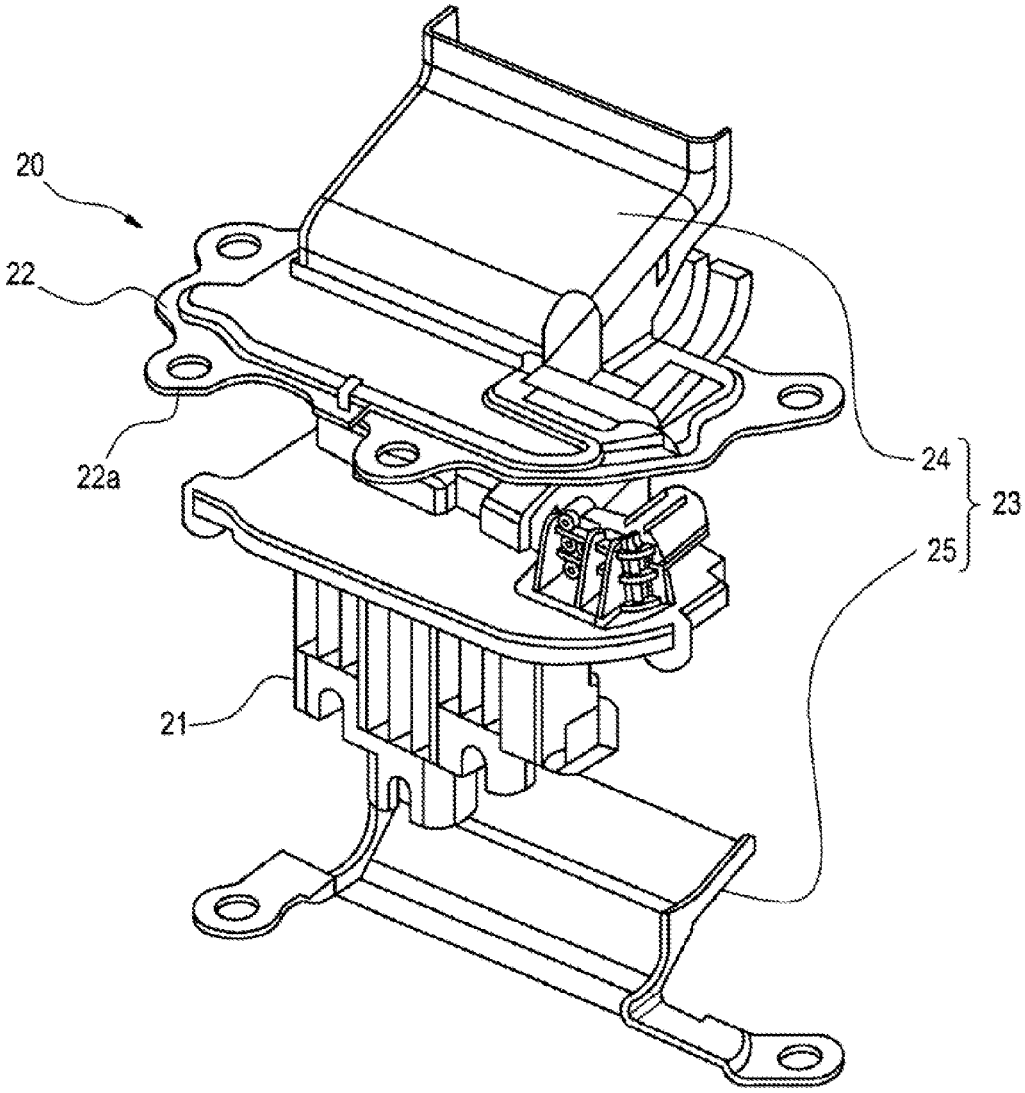
FIG. 5 is an exploded perspective view showing a lower shielded connector of the electric cable with shielded connector.
Figure 6:
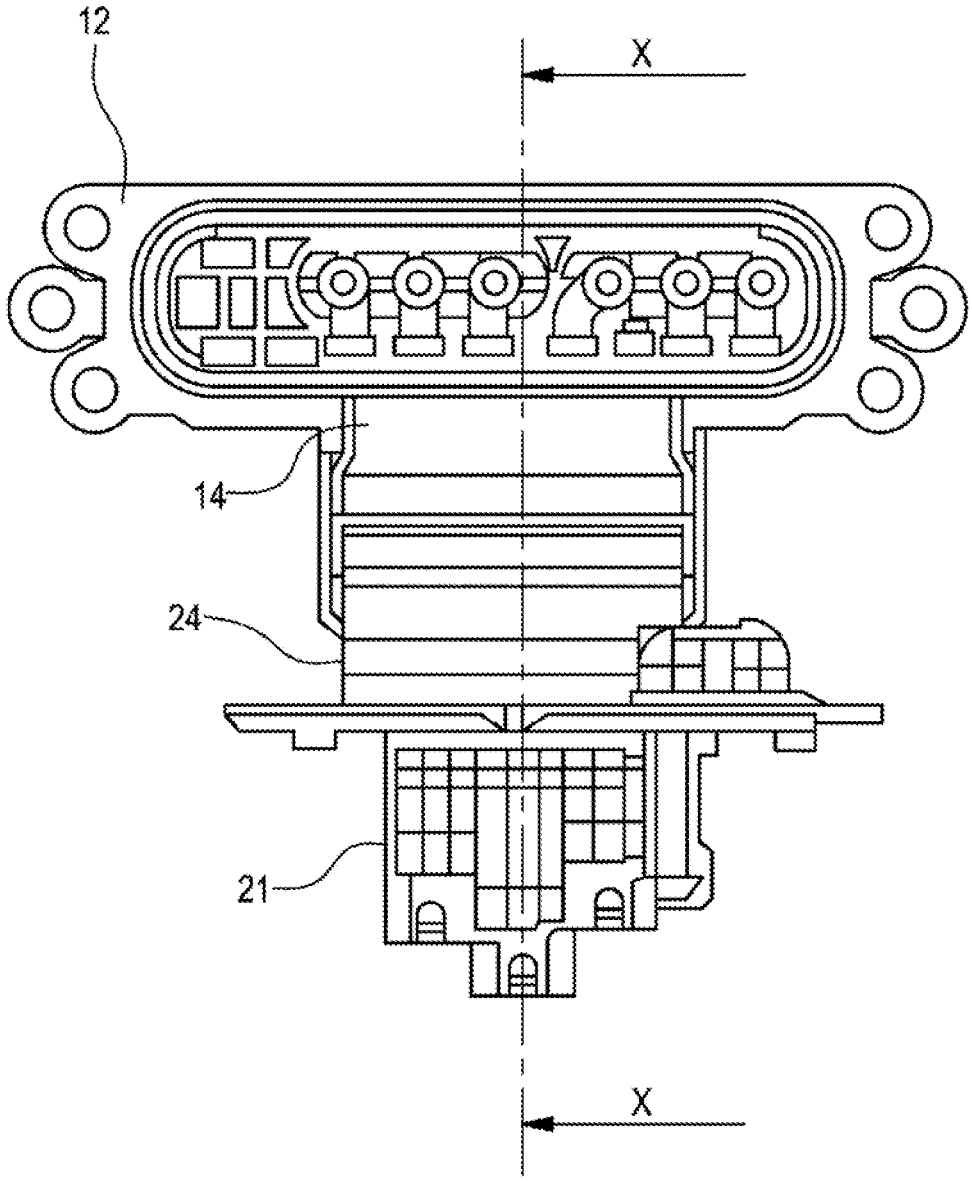
FIG. 6 is a front view showing a state where the upper shielded connector and the lower shielded connector of the electric cable with shielded connector are connected.
Figure 7:
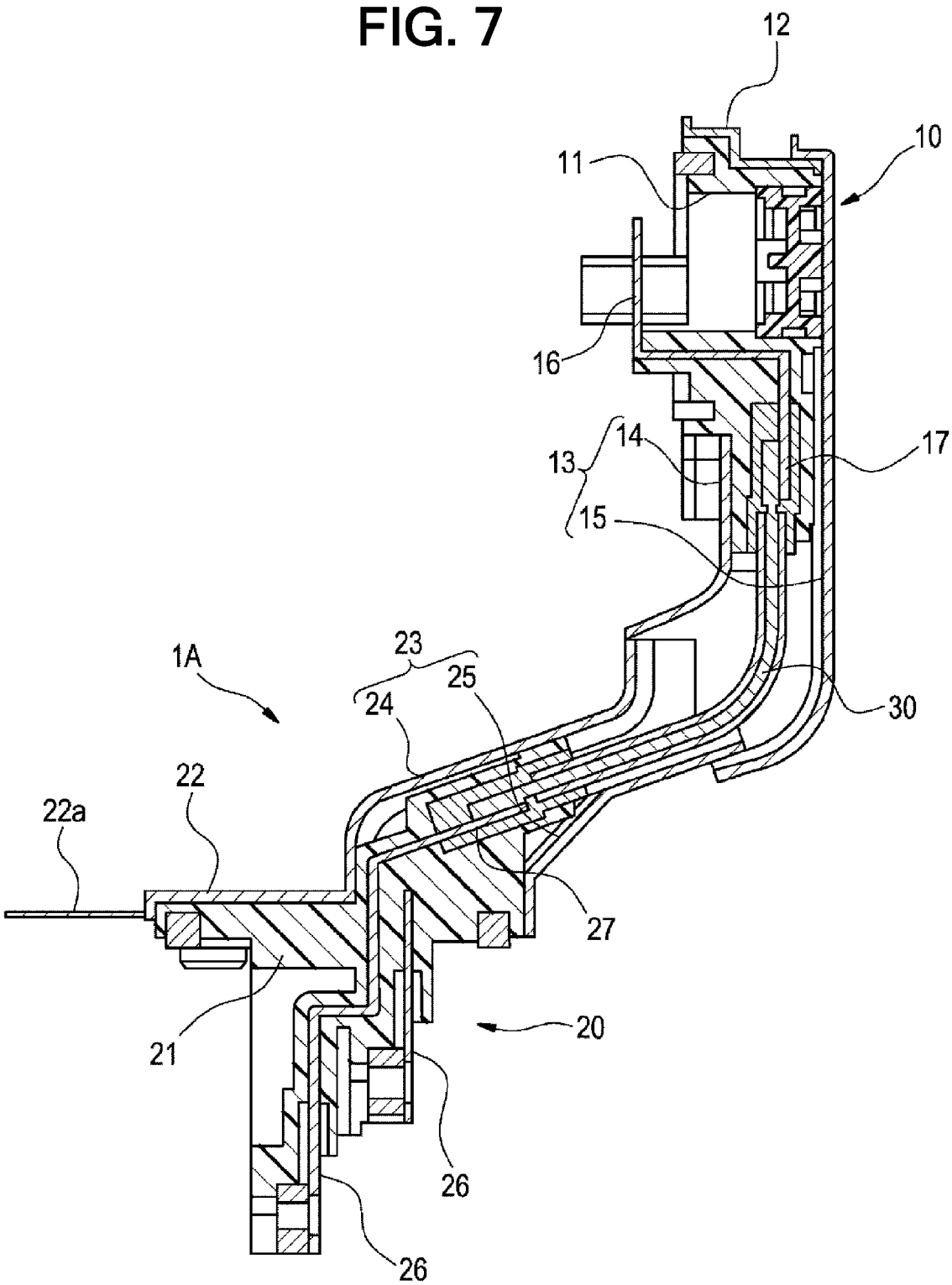
FIG. 7 is a sectional view taken along a line X-X in FIG. 6.

Each of base ends 17 and 27 of the terminals 16 and 26 of the shielded connectors 10 and 20 is respectively connected to terminal ends of the conductor of the electric wire 30 by a means, such as pressing, and thus received in the housings 11 and 21, and distal ends of the terminals 16 and 26 are exposed to the outside of the housings 11 and 21 and adapted to be electrically connectable with connector terminals of instruments (not shown). Also, the shield shells 12 and 22 are integrally provided with earth terminals 12*a* and 22*a* having attachment holes for the connectors. Herein, the shielded connector 10 on an upper side in FIGS. 1 to 3B is distinctively referred to as an upper connector and the shielded connector 20 on a lower side is referred to as a lower connector. As shown in FIGS. 1 and 2B, the upper connector 10 is arranged such that a connection direction thereof to a connector of an instrument (not shown) is oriented to a lateral direction, and the lower connector 20 is arranged such that a connection direction thereof to connectors of an instrument (not shown) is oriented to a downward direction. In addition, the electric wire 30 electrically connected between both of the shielded connectors 10 and 20 is bent in a generally L shape in the middle thereof.

As a shield cover for covering the outer side of the electric wire 30, two upper and lower cylindrical shield covers 13 and 23 made of a conductive metal plate are used. An upper end (one end) of the upper shield cover 13 is fixed on the shield shell 12 of the upper connector 10 and a lower end (the other end) of the upper shield cover 13 is formed as a free end. Also, a lower end (one end) of the lower shield cover 23 is fixed on the shield shell 22 of the lower connector 20 and an upper end (the other end) of the lower shield cover 23 is formed as a free end. In addition, the free end, which is the lower end of the upper shield cover 13, and the free end, which is the upper end of the lower shield cover 23, are abutted to each other or are lapped on each other, so that shielding ability between the free ends of the upper and lower tubular covers 13 and 23 divided into upper and lower sides can be ensured.

In this case, considering assembly property, the upper and lower cylindrical shield covers 13 and 23 are respectively constituted of a combination of a pair of semi-cylindrical bodies 14 and 15, and 24 and 25, whose side edges are lapped on each other. One semi-cylindrical body 15 of the pair of semi-cylindrical bodies 14 and 15 constituting the upper shield cover 13 is fitted to an outer side of the shield shell 12 of the upper connector 10 to be detachably fixed on the shield shell 12, and the other semi-cylindrical body 14 is fixed by being detachably fitted to the housing 11 and also being detachably fitted to inner surfaces of side edges of the one semi-cylindrical body 15. Also, one semi-cylindrical body 24 of the pair of semi-cylindrical bodies 24 and 25 constituting the lower shield cover 23 is integrally fixed to the shield shell 22 of the lower connector 20, and the other semi-cylindrical body 25 is fixed by being detachably fitted to the housing 21 and also being detachably fitted to outer surfaces of side edges of the one semi-cylindrical body 24.

The cylindrical shield covers 13 and 23 are formed in a curved shape along an arranging path of the electric wire 30, and the free ends thereof are adjacent to each other. Also, a conductive elastic member 40 is interposed between the free ends of the cylindrical shield covers 13 and 23 to shield a gap between the free ends and also to prevent a direct contact between the free ends. In this case, the conductive elastic member 40 is previously fixed on either one of the free ends of the cylindrical shield covers 13 and 23.

According to the electric cable with shielded connector 1 configured as described above, because the outer side of the electric wire 30 between the shielded connectors 10 and 20 on both ends thereof is covered with two cylindrical shield covers 13 and 23 made of a conductive metal plate, shielding ability of the electric wire 30 exposed between the shielded connectors 10 and 20 can be ensured.

Also, the other end of each of two cylindrical shield covers 13 and 23 is separated from each other and is formed as the free ends, but the free ends are abutted to each other or are lapped on each other, and as a result, shielding ability of the gap between the free ends can be ensured, thereby eliminating a shield omission portion (i.e., a portion having an insufficient shielding ability against electromagnetic waves).

Further, two cylindrical shield covers 13 and 23 are constituted of a conductive metal plate, and the one end of each thereof is respectively fixed to the shield shells 12 and 22 of the shielded connectors 10 and 20, and as a result, cumbersome works, such as caulking and fixing a flexible braid to a shield shell by a shield ring as in a conventional case, are not required, thereby achieving reduction of the number of components and reduction of operation man-hours.

Further, because two cylindrical shield covers 13 and 23 are not coupled and fixed to each other, but each can relatively freely move to some extent, movability between the shielded connectors 10 and 30 on both ends can ensured to a required extent, thereby preventing disturbing some movement required upon connection of the shielded connectors 10 and 20.

Also, two cylindrical shield covers 13 and 23 are made of the metal plate serving as a protection portion having impact resistance, and as a result, are not damaged even if colliding with other components due to vibrations of instruments or a vehicle, or the like.

Further, according to the electric cable with shielded connector 1 of the first embodiment, because two cylindrical shield covers 13 and 23 are respectively constituted of a combination of two semi-cylindrical bodies 14 and 15, and 24 and 25, whose side edges are lapped on each other, the cylindrical shield covers 13 and 23 can be assembled on the outer side of the electric wire 30 after each of pairs of semi-cylindrical bodies 14 and 15, and 24 and 25 is opened and then the shielded connectors 10 and 20 are attached on both ends of the electric wire 30, thereby ensuring a degree of freedom in an assembly operation.

Further, the conductive elastic member 40 is disposed between the free ends of two cylindrical shield covers 13 and 23, and as a result, the conductive elastic member 40 can fill up a gap between the free ends of two cylindrical shield covers 13 and 23, thereby surely eliminating a shield omission portion (i.e., a portion having an insufficient shielding ability against electromagnetic waves).

In addition, two cylindrical shield covers 13 and 33 are electrically connected to each other through the conductive elastic member 40, and therefore, by only earthing the shield shell 12(22) or the shield cover 13(23) of one shield connector 10(20), shielding ability of the shield shell 22(12) or the shield cover 23(13) of the other shield connector 20(10) can be ensured.

Also, because a direct contact between the cylindrical shield covers 13 and 23 made of a conductive metal plate can be avoided due to the conductive elastic member 40, a damage or noise caused by contact between hard metal plates due to vibrations of instruments can be prevented.

Further, the electric cable with shielded connector 1 of the first embodiment can be easily manufactured by a design change of the cylindrical shield covers 13 and 23, and thus, separate components, such as a pipe shield, which have been previously used, don't need to be newly manufactured and also molds don't need to be newly provided.

In addition, the connection direction can be variously set by a combination of the upper cylindrical shield cover 13 and the lower cylindrical shield cover 23, thereby increasing variations of the connection form.

FIGS. 4 to 7 show a second embodiment of the present invention. The second embodiment has a configuration in which the conductive elastic member 40 in the configuration of the first embodiment is omitted. Therefore, an exterior perspective view of the second embodiment is the same as that of FIG. 1. In the second embodiment, the same members as those of the first embodiment are designated by the same reference numerals, and accordingly, the description thereof will be omitted or simplified.

As shown in FIGS. 4 to 7, according to an electric cable with shielded connector 1A of the second embodiment, an outer side of an electric wire 30 between shielded connectors 10 and 20 on both ends thereof is covered with two cylindrical shield covers 13 and 23. Thus, shielding ability of the electric wire 30 exposed between the shielded connectors 10 and 20 can be ensured. In addition, the other end of each of two cylindrical shield covers 13 and 23 are separated from each other and are formed as the free ends, but the free ends are abutted to each other or are lapped on each other, and as a result, shielding ability of a gap between the free ends can be ensured, thereby eliminating a shield omission portion (i.e., a portion having an insufficient shielding ability against electromagnetic waves).

Also, two cylindrical shield covers 13 and 23 are constituted of a conductive metal plate, and the one end of each thereof is respectively fixed to shield shells 12 and 22 of the shielded connectors 10 and 20, and as a result, cumbersome works, such as caulking and fixing a flexible braid to a shield shell by a shield ring as in a conventional case, are not required, thereby achieving reduction of the number of components and reduction of operation man-hours.

Further, because two cylindrical shield covers 13 and 23 are not coupled and fixed to each other, but each can relatively freely move to some extent, movability between the shielded connectors 10 and 30 on both ends can ensured to a required extent, thereby preventing disturbing some movement required upon connection of the shielded connectors 10 and 20. Also, two cylindrical shield covers 13 and 23 are made of the metal plate serving as a protection portion having impact resistance, and as a result, are not damaged even if colliding with other components due to vibrations of instruments or a vehicle, or the like.

Further, according to the electric cable with shielded connector 1A of the second embodiment, because two cylindrical shield covers 13 and 23 are respectively constituted of a combination of a pair of semi-cylindrical bodies 14 and 15, and 24 and 25, whose side edges are lapped on each other, the cylindrical shield covers 13 and 23 can be assembled on the outer side of the electric wire 30 after each of pairs of semi-cylindrical bodies 14 and 15, and 24 and 25 is opened and then the shielded connectors 10 and 20 are attached on both ends of the electric wire 30, thereby ensuring a degree of freedom in an assembly operation.

Also, the electric cable with shielded connector 1A of the second embodiment can be easily manufactured by a design change of the cylindrical shield covers 13 and 23, and thus, separate components, such as a pipe shield, which have been previously used, don't need to be newly manufactured and also molds don't need to be newly provided.

In addition, the connection direction can be variously set by a combination of the upper cylindrical shield cover 13 and the lower cylindrical shield cover 23, thereby increasing variations of the connection form.

FIGS. 8 to 10B show a third embodiment of the present invention. The third embodiment has a configuration in which dimensions of the semi-cylindrical bodies 14 and 15 of the upper cylindrical shield cover 13 in the configuration of the first embodiment are specially set. Therefore, in the third embodiment, the same members as those of the first embodiment and the second embodiment are designated by the same reference numerals, and accordingly, the description thereof will be omitted or simplified.

As shown in FIGS. 8 to 10B, according to an electric cable with shielded connector 1B of the third embodiment, free ends of two upper and lower cylindrical shield covers 13 and 23 are not abutted to each other, but are lapped on each other by a suitable dimension.

Figure 8:
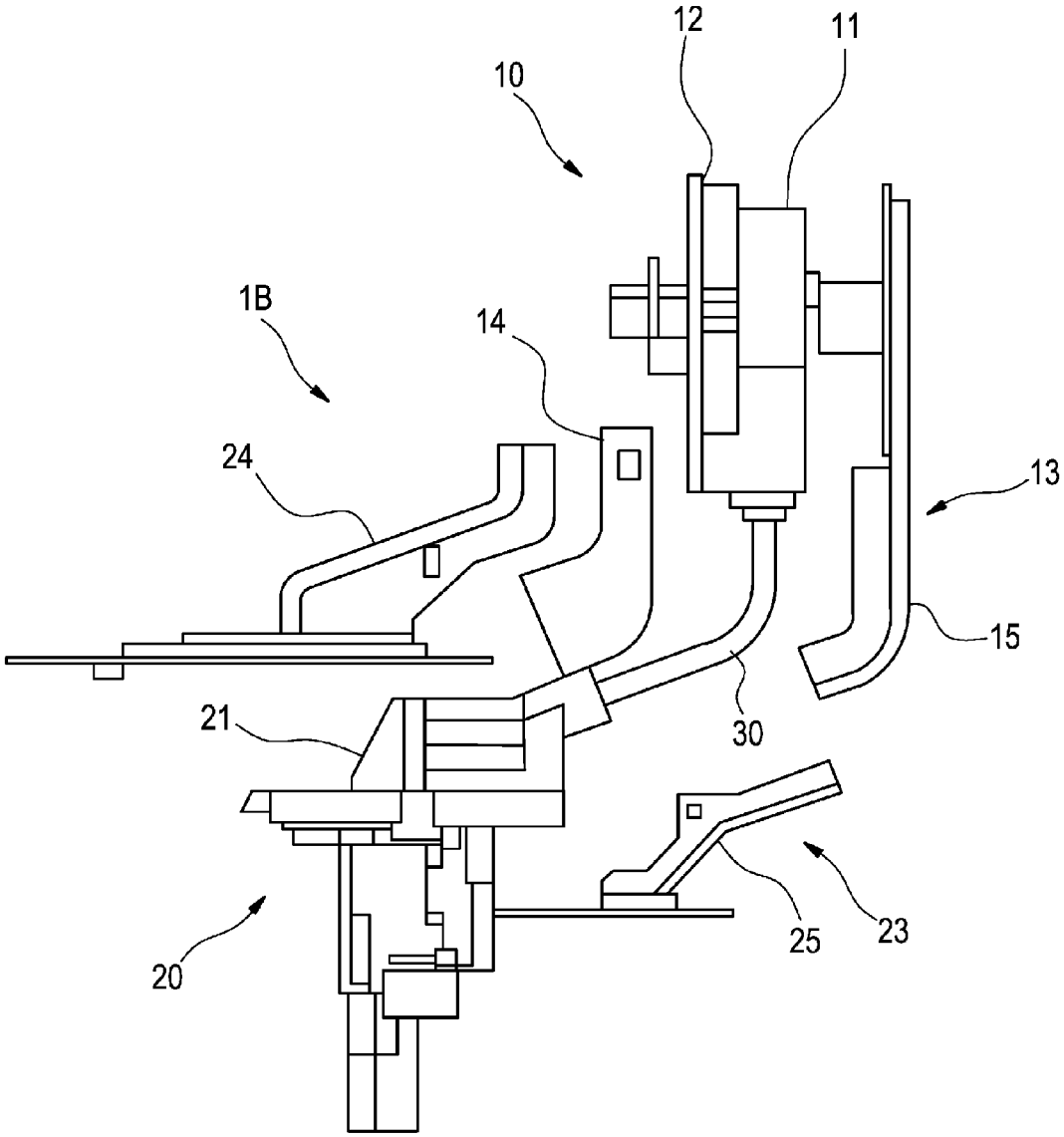
FIG. 8 is an exploded perspective view showing an electric cable with shielded connector according to a third embodiment of the present invention.
Figure 9A:
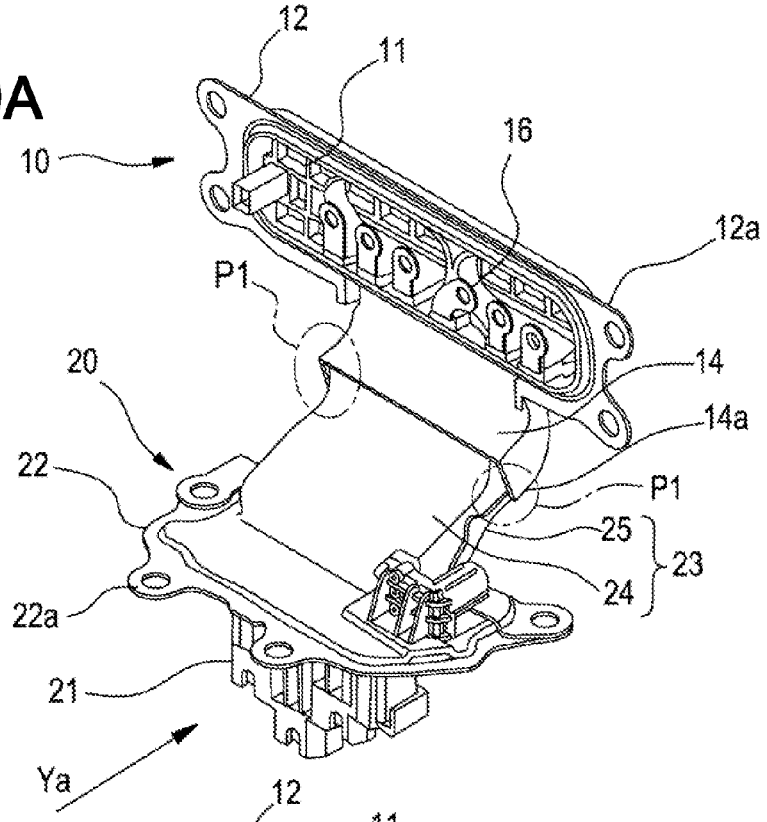
Figure 9B:
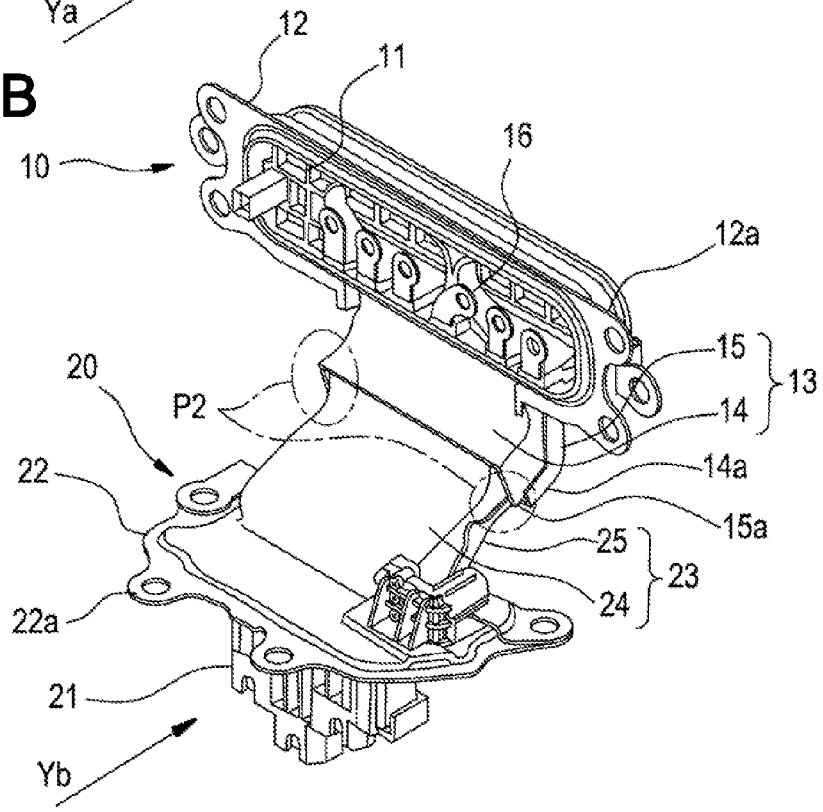
Figure 10A:
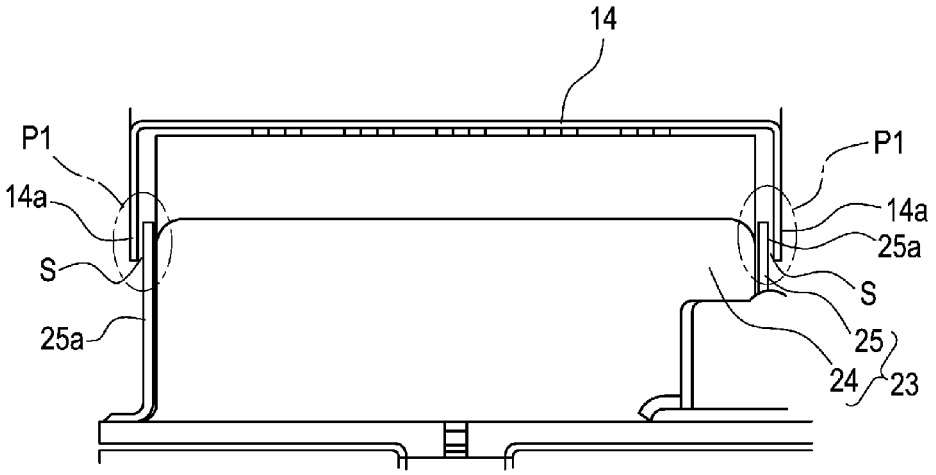
FIG. 10A is a partial front view as viewed in a direction of an arrow Ya in FIG. 9A.
Figure 10B:
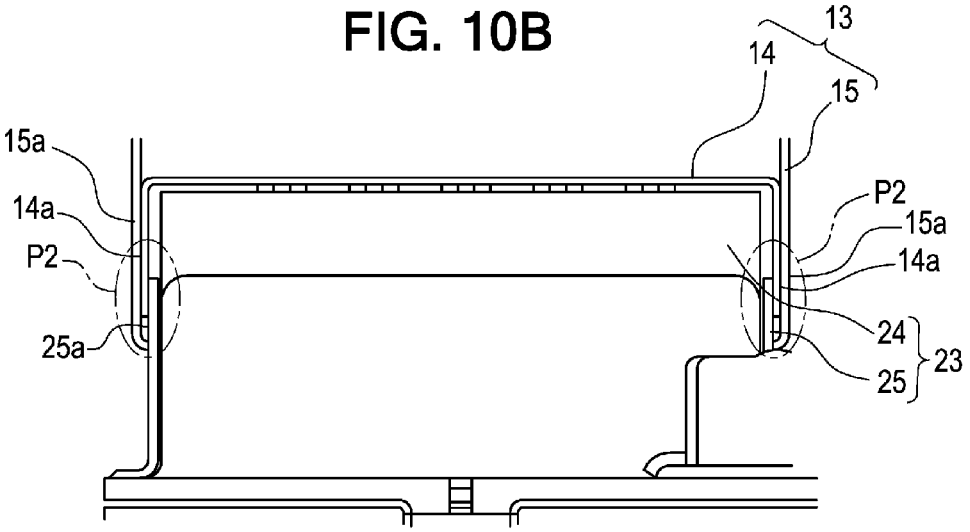
FIG. 10B is a partial front view as viewed in a direction of an arrow Yb in FIG. 9B.
Figure 11:
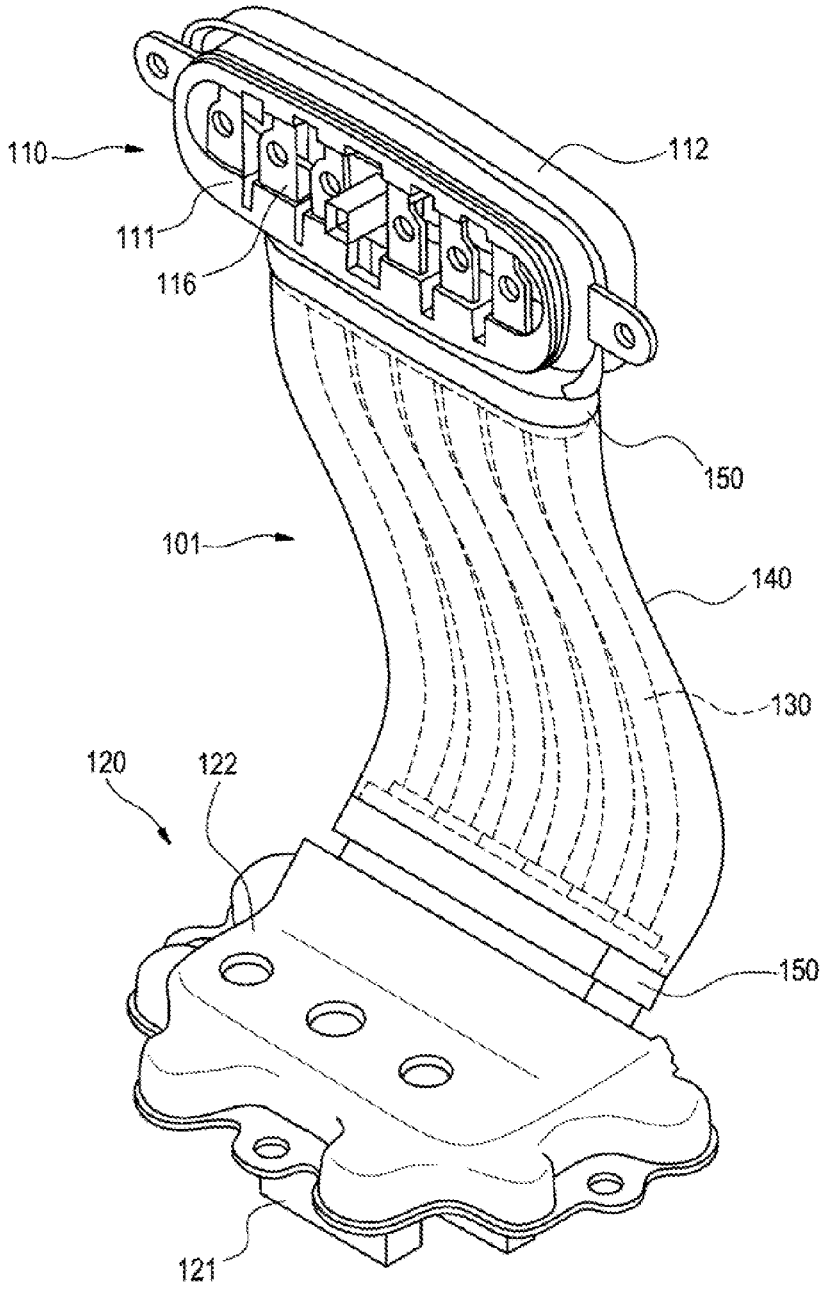
FIG. 11 is a perspective view showing the exterior of a conventional shield-connectored electric cable.
Figure 12:
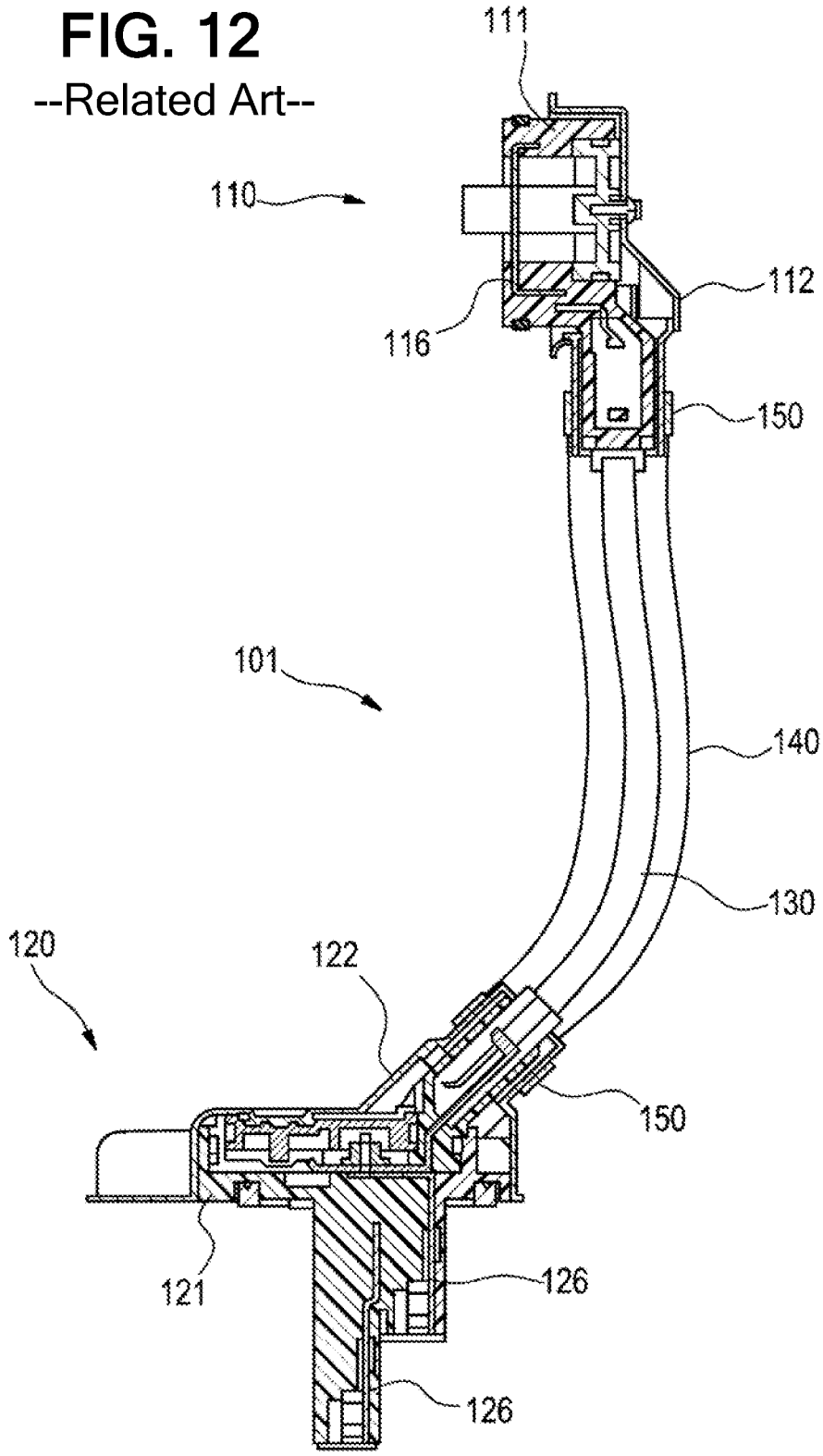
FIG. 12 is a sectional view showing the electric cable with shielded connector.

In addition, a dimension between both side edges 14*a* of the semi-cylindrical body 14, which becomes an inner side in lapped portions between side edges 14*a* and 15*a*, of a pair of semi-cylindrical bodies 14 and 15 of the upper cylindrical shield cover 13 in FIGS. 8, 9B and 10B, which is lapped on the outer side of the lower cylindrical shield cover 23 in FIGS. 8 to 10B, which becomes an inner side in lapped portions of the free ends of two cylindrical shield covers 13 and 23, is formed to ensure a gap S between the semi-cylindrical body 14 and the lower cylindrical shield cover 23 (outer surfaces of side edges 25*a* of the outer side semi-cylindrical body 25) in a free state (a state before the outer side semi-cylindrical body 15 is fitted thereon), as shown in FIGS. 9A and 10A. A part enclosed by P1 in FIGS. 9A and 10B shows that the gap S exists.

In addition, a dimension between both side edges 15*a* of the semi-cylindrical body 15, which becomes the outer side in the lapped portions between side edges 14*a* and 15*a*, of the pair of semi-cylindrical bodies 14 and 15 of the upper cylindrical shield cover 13, is formed to cause the side edges 14*a* of the inner side semi-cylindrical body 14 to be pressed and deformed inward as the semi-cylindrical body 15 is fitted on the inner side semi-cylindrical body 13 in the free state from the rear side to allow the side edges 14*a* and 15*a* to be lapped on each other, so that the gap S is eliminated and thus the side edges 14*a* of the inner side semi-cylindrical body 14 is pressed against and closely contacted to the lower cylindrical shield cover 23. A part enclosed by P2 in FIGS. 9B and 10B shows that the gap S in FIG. 10A is eliminated and thus, the side edges 15*a* and 14*a* of the outer and inner side semi-cylindrical bodies 15 and 14 are pressed against and closely contacted to the lower shield cover 23.

According to the electric cable with shielded connector 1B of the third embodiment as described above, the outer side of the electric wire 30 between the shielded connectors 10 and 20 on both ends thereof is covered with two cylindrical shield covers 13 and 23, and thus, shielding ability of the electric wire 30 exposed between the shielded connectors 10 and 20 can be ensured. In addition, the other end of each of two cylindrical shield covers 13 and 23 is separated from each other and are formed as the free ends, but the free ends are lapped on each other, and as a result, shielding ability of a gap between the free ends can be ensured, thereby eliminating a shield omission portion (i.e., a portion having an insufficient shielding ability against electromagnetic waves).

Also, two cylindrical shield covers 13 and 23 are constituted of a conductive metal plate, and the one end of each thereof is respectively fixed to shield shells 12 and 22 of the shielded connectors 10 and 20, and as a result, cumbersome works, such as caulking and fixing a flexible braid to a shield shell by a shield ring as in a conventional case, are not required, thereby achieving reduction of the number of components and reduction of operation man-hours.

Further, because two cylindrical shield covers 13 and 23 are not coupled and fixed to each other, but each can relatively freely move to some extent, movability between the shielded connectors 10 and 30 on both ends can ensured to a required extent, thereby preventing disturbing some movement required upon connection of the shielded connectors 10 and 20. Also, two cylindrical shield covers 13 and 23 are made of the metal plate serving as a protection portion having impact resistance, and as a result, are not damaged even if colliding with other components due to vibrations of instruments or a vehicle, or the like.

Further, according to the electric cable with shielded connector 1B of the third embodiment, because two cylindrical shield covers 13 and 23 are respectively constituted of a combination of a pair of semi-cylindrical bodies 14 and 15, and 24 and 25, whose side edges are lapped on each other, the cylindrical shield covers 13 and 23 can be assembled on the outer side of the electric wire 30 after each of pairs of semi-cylindrical bodies 14 and 15, and 24 and 25 is opened and then the shielded connectors 10 and 20 are attached on both ends of the electric wire 30, thereby ensuring a degree of freedom in an assembly operation.

Also, the electric cable with shielded connector 1B of the third embodiment can be easily manufactured by a design change of the cylindrical shield covers 13 and 23, and thus, separate components, such as a pipe shield, which have been previously used, don't need to be newly manufactured and also molds don't need to be newly provided.

Further, the connection direction can be variously set by a combination of the upper cylindrical shield cover 13 and the lower cylindrical shield cover 23, thereby increasing variations of the connection form.

Also, according to the electric cable with shielded connector 1B of the third embodiment, the semi-cylindrical body 14, which becomes the inner side in lapped portions between side edges 14*a* and 15*a*, of the pair of semi-cylindrical bodies 14 and 15 of the upper cylindrical shield cover 13, which becomes the outer side in the lapped portions between the free ends of two cylindrical shield covers 13 and 23, is formed to have a dimension which can ensure a gap S between the semi-cylindrical body 14 and the lower cylindrical shield cover 23 in a free state. Accordingly, in a state before the outermost semi-cylindrical body 15 is assembled, the gap S exists, and therefore, rubbing (sliding) between the inner side semi-cylindrical body 14 and the lower cylindrical shield cover 23 can be prevented. As a result, the lapped portions between the free ends of two cylindrical shield covers 13 and 23 can be smoothly moved.

In addition, in a state where the outermost semi-cylindrical body 15 has been assembled, the inner side semi-cylindrical body 14 can be pressed and deformed inward to be pressed against and closely contacted to the lower cylindrical shield cover 23 and thereby to eliminate the gap S, and therefore, two cylindrical shield covers 13 and 23 can be surely maintained in an electrically interconnected state and a high shielding performance can be exhibited.

Meanwhile, the present invention is not limited to the foregoing embodiments, but appropriate changes, modifications or the like thereof can be made. In addition, material, shape, dimension, number, installation position and the like of each of the components of the foregoing embodiments are not limited but arbitrary as long as the present invention can be achieved.

INDUSTRIAL APPLICABILITY

According to the present invention, an electric cable with shielded connector can be provided, which can ensure shielding ability and movability between shielded connectors on both ends, achieve reduction of the number of components and reduction of assembling man-hours, is not damaged even if colliding with other components due to vibrations or the like, and also does not need separate components newly manufactured.

REFERENCE SIGNS LIST

1, 1A, 1B Electric cable with shielded connector
10, 20 Shielded-connector
11, 21 Housing
12, 22 Shield shell
13, 23 Cylindrical shield cover
14, 15, 24, 25 Semi-cylindrical body
14*a*, 15*a*, 25*a* Side edge
16, 26 Terminal
30 Electric wire
Conductive elastic member
S Gap

What is claimed is:

1. An electric cable with shielded connector comprising:
a flexible electric wire;
shielded connectors that are respectively attached on both ends of the flexible electric wire; and
a shield cover that is provided to cover an outer side of the electric wire between the shielded connectors, the shielded connectors each including a terminal electrically connected to a conductor of the electric wire, an insulation material housing holding the terminal, and a shield shell covering an outer side of the housing,
wherein the shield cover is constituted of two cylindrical shield covers made of a conductive metal plate, one end of each of the two cylindrical shield covers is respectively fixed on the shield shells of the shield connectors on both ends of the electric wire, the other end of each of the two cylindrical shield covers is formed as a free end, and the free ends of the two cylindrical shield covers are abutted to each other or are lapped on each other, to ensure shielding ability between the free ends of the two cylindrical shield covers.

2. The electric cable with shielded connector according to claim 1, wherein the two cylindrical shield covers are respectively constituted of a combination of a pair of semi-cylindrical bodies, whose side edges are lapped on each other, and
wherein one semi-cylindrical body of the pair of semi-cylindrical bodies is fixed on the shield shell and the other semi-cylindrical body is detachably fixed on the shield shell or the one semi-cylindrical body.

3. The electric cable with shielded connector according to claim 1, wherein a conductive elastic member is interposed between the free ends of the two cylindrical shield covers to shield a gap between the free ends and also to prevent a direct contact between the free ends.

4. The electric cable with shielded connector according to claim 2, wherein a conductive elastic member is interposed between the free ends of the two cylindrical shield covers to shield a gap between the free ends and also to prevent a direct contact between the free ends.

5. The electric cable with shielded connector according to claim 2, wherein the free ends of the two cylindrical shield covers are lapped on each other, and wherein one semi-cylindrical body, which becomes an inner side in lapped portions between side edges, of a pair of semi-cylindrical bodies of the other cylindrical shield cover, which is lapped on an outer side of one cylindrical shield cover which becomes an inner side in lapped portions of the free ends of the two cylindrical shield covers, is formed to have a dimension which is possible to have a gap between the one semi-cylindrical body and the one cylindrical shield cover in a free state, and also the other semi-cylindrical body, which becomes an outer side in the lapped portions between side edges, of the pair of semi-cylindrical bodies of the other cylindrical shield cover, is formed to have a dimension which allows the one semi-cylindrical body to be pressed and deformed inward to fill the gap, and the one semi-cylindrical body to be pressed against and closely contacted to the one cylindrical shield cover, as the other semi-cylindrical body is fitted on the one semi-cylindrical body in the free state from the rear side to allow the side edges to be lapped on each other.

* * * * *